US010422162B2

(12) United States Patent
Uhlmann

(10) Patent No.: US 10,422,162 B2
(45) Date of Patent: Sep. 24, 2019

(54) DOOR HANDLE

(71) Applicant: Günter Uhlmann, Höchberg (DE)

(72) Inventor: Günter Uhlmann, Höchberg (DE)

( * ) Notice: Subject to any disclaimer, the term of this patent is extended or adjusted under 35 U.S.C. 154(b) by 0 days.

(21) Appl. No.: 15/269,255

(22) Filed: Sep. 19, 2016

(65) Prior Publication Data

US 2017/0016252 A1 Jan. 19, 2017

Related U.S. Application Data

(63) Continuation of application No. PCT/EP2015/055580, filed on Mar. 17, 2015.

(30) Foreign Application Priority Data

Mar. 18, 2014 (DE) ..... 10 2014 103 666

(51) Int. Cl.
*E05B 47/06* (2006.01)
*E05B 47/00* (2006.01)
(Continued)

(52) U.S. Cl.
CPC ..... *E05B 47/068* (2013.01); *E05B 3/06* (2013.01); *E05B 13/005* (2013.01); *E05B 15/04* (2013.01);
(Continued)

(58) Field of Classification Search
CPC ..... E05B 47/068; E05B 3/06; E05B 15/04; E05B 47/0001; E05B 13/005;
(Continued)

(56) References Cited

U.S. PATENT DOCUMENTS 233,693 A * 10/1880 Pettet ..... E05B 3/06 292/348
3,939,679 A * 2/1976 Barker ..... E05B 47/068 341/181
(Continued)

FOREIGN PATENT DOCUMENTS

DE 9013254 U1 5/1991
DE 198 54 454 A1 6/2000
(Continued)

*Primary Examiner* — Llyod A Gall
(74) *Attorney, Agent, or Firm* — Yakov S. Sidorin; Quarles & Brady LLP

(57) ABSTRACT

A door handle with a door-side output shaft and a handle facing away from the door, the output shaft and handle having a common rotational axis and being connected via an electromechanical clutch, may be particularly compact and may have a particularly low energy intake for shifting the clutch by providing the output shaft with a recess on the side facing towards the handle, in which a coupling element is displaceably mounted; by providing the door handle with a receiving area for the coupling element 40 opposite to the recess; and by arranging a linear drive in the handle, the linear drive acting on the coupling element in order to move the coupling element in the axial direction so far out of the recess that the coupling element engages both into the recess as well as into the receiving area in order to close the clutch, and the coupling element is moved out of the receiving area back into the recess in order to open the clutch.

14 Claims, 4 Drawing Sheets

(51) Int. Cl.
*E05B 3/06* (2006.01)
*E05B 13/00* (2006.01)
*E05B 15/04* (2006.01)

(52) U.S. Cl.
CPC .. *E05B 47/0001* (2013.01); *E05B 2015/0496* (2013.01); *E05B 2047/002* (2013.01); *E05B 2047/0016* (2013.01)

(58) Field of Classification Search
CPC ..... E05B 2047/002; E05B 2047/0016; E05B 2015/0496; E05B 2047/0036; E05B 47/0642; E05B 2047/0026
USPC ..... 70/223, 277, 472, 278.1, 278.2, 278.3, 70/278.7, 279.1, 462, 280–283, 283.1, 70/218, 222; 292/336.3, 347, 244
See application file for complete search history.

(56) References Cited

U.S. PATENT DOCUMENTS 4,073,527 A * 2/1978 Schlage ..... E05B 47/068 292/144
4,177,657 A * 12/1979 Aydin ..... E05B 47/068 70/219
4,956,984 A * 9/1990 Chi-Cheng ..... E05B 47/068 70/277
5,000,018 A * 3/1991 Eisermann ..... E05B 47/068 70/223
5,018,375 A * 5/1991 Tully ..... E05B 47/068 292/144
5,040,391 A * 8/1991 Lin ..... E05B 13/101 70/277
5,083,122 A * 1/1992 Clark ..... E05B 47/0012 340/5.22
5,447,047 A * 9/1995 Lin ..... E05B 47/0043 70/218
5,884,515 A * 3/1999 Milman ..... E05B 47/068 192/84.21
5,933,086 A 8/1999 Tischendorf et al.
5,960,656 A * 10/1999 Yao ..... E05B 47/068 70/223
5,974,912 A * 11/1999 Cheng ..... E05B 13/101 292/DIG. 27
6,041,630 A * 3/2000 Shen ..... E05B 13/101 70/149
6,334,348 B1 * 1/2002 Ming-Chih ..... E05B 47/068 292/DIG. 27
6,460,903 B1 10/2002 Ming-Chih
6,807,834 B2 * 10/2004 Tsai ..... E05B 47/068 70/149
6,845,642 B2 * 1/2005 Imedio Ocana ..... E05B 47/068 70/222
6,865,916 B2 * 3/2005 Goldman ..... E05B 47/0615 292/DIG. 27
9,273,489 B2 * 3/2016 Hickman ..... E05B 47/0012
2002/0144526 A1 * 10/2002 Ming-Chih ..... E05B 47/068 70/218
2005/0050928 A1 * 3/2005 Frolov ..... E05B 47/068 70/278.3
2009/0277232 A1 * 11/2009 Walsh, III ..... E05B 47/0661 70/278.7
2010/0012454 A1 * 1/2010 Imedio Ocana .... E05B 47/0642 192/84.6
2010/0122561 A1 5/2010 Lui
2012/0198897 A1 * 8/2012 Lui ..... E05B 47/0012 70/280
2016/0251876 A1 * 9/2016 Carlsson ..... E05B 47/0012 70/445

FOREIGN PATENT DOCUMENTS

DE 10 2004 056989 A1 6/2006
DE 102012020450 A1 4/2014
DE 102012020451 A1 4/2014
EP 1881135 A1 1/2008
EP 2650457 A1 10/2013
KR 2011 0096955 A 8/2011
WO 96/41486 12/1996
WO 98/15703 A1 4/1998
WO 2011/119 097 A1 9/2011
WO 2014060547 A1 4/2014

* cited by examiner

DOOR HANDLE

CROSS-REFERENCE TO RELATED APPLICATIONS

This application is a continuation of pending International Application No. PCT/EP2015/055580 filed on Mar. 17, 2015 and now published as WO 2015/140180, which designates the United States and claims priority from German Application No. 10 2014 103 666.2 filed on Mar. 18, 2014. The disclosure of each of the above-identified patent documents is incorporated herein by reference.

BACKGROUND OF THE INVENTION

1. Field of the Invention

The invention relates to a door handle, e.g. to a doorknob, with a door-side output shaft and a handle facing away from the door leaf, wherein the output shaft and the handle have a common rotation axis and are connected by a preferably electromechanical clutch, so that with an open clutch the handle may be operated, i.e. may be rotated, without entraining the output shaft. With a closed clutch, however, the handle and the output shaft are non-rotatably connected with each other.

2. Description of Relevant Art

In Europe, so-called case locks are generally used in doors, which are also known as mortise locks. Mortise locks are inserted into a recess in the narrow side of the door which is revealed when opening of the door, and are fixed there. These mortise locks have a latch and usually a dead bolt (bolt, for short). At least the latch may usually be retracted by a door handle (mostly in a form of a doorknob) to open the door. In so-called anti-panic locks, also the dead bolt is coupled with the handle, such that also this bolt is retracted upon actuation of the handle. To initiate the rotational movement of the door handle in the mortise lock, the mortise lock has a so-called nut, in which usually a square shaft extending orthogonally to the door leaf is inserted, such that it protrudes at least on one side over the door leaf. The nut is thus some sort of socket for (e.g. form fittingly) receiving the shaft. The door handle is then placed on this free end in a rotationally locked manner.

Locking or unlocking the door is usually done by so-called cylinder locks, which are inserted in the mortise locks. The cylinder locks have a locking cam arranged on a shaft, which cam interacts with the mortise lock. The locking cylinder allows rotation of the locking cam by a user, provided the user is authorized, whereby either a key or a knob serves for actuating the locking cam by the user.

Electromechanical locking systems are based on the electronic identification of a key. The key may be, for example, an active or passive transponder. A lock control exchanges data with the key, thereby checks the authorization of the key, and possibly releases the lock. To release the lock in electromagnetic locking cylinders, the locking cam must be non-rotatably connected (i.e. coupled) with a handle, e.g. a knob. In an unreleased state, at least the handle arranged on the outside of the door is not non-rotatably connected with the locking cam (un-coupled state). For switching between the coupled and the uncoupled locking cam, a clutch (also inter-changeably referred to herein as a switchable clutch) is required. Such clutch, being switchable by the lock control, has on the one hand to be so small that it can be integrated into a locking cylinder, and on the other hand has to absorb comparatively high torques, such that even malfunctioning, e.g. sticking locks can be opened. The energy supply is mostly provided by batteries, which is why the energy requirement of the coupling for a closing and opening operation has to be minimized.

In DE 198 54 454 C2, an electromechanical locking cylinder with an external knob is described, which can be non-rotatably coupled with a locking cam via an electromotively actuated clutch. For this purpose, a shaft is guided from the outside knob into an inner knob, where it carries a support for a linear drive. By means of the linear drive, a coupling element may be inserted in a recess of the hollow shaft which is as well led out from the locking cylinder shaft. The end of the hollow shaft being led out is extended in a flange-like manner and carries the inner knob. The other end of the hollow shaft carries the locking cam.

DE 10 2004 056 989 A1 also describes a locking cylinder with a clutch for a non-rotatable connection of two knobs with a locking cam. The outer knob sits on a pin mounted in the locking cylinder, which pin is non-rotatably connected to a hollow shaft. A coupling gear sits non-rotatably on the hollow shaft. The coupling gear is located in the door-inner-side half of the locking cylinder and is overlapped by axially displaceable coupling claws. The coupling claws each have a radially inwardly facing locking protrusion at their distal end, which can be inserted between the teeth of the coupling gear. Thus, the claws can be non-rotatably coupled to the hollow shaft. When, in addition, the claws engage with counter-claws of a sleeve bearing the locking cam, the lock can be operated by turning the outer knob. The claws are located on an axially displaceable ring and extend from the ring towards the outside of the door. In addition, the ring is permanently non-rotatably connected to a flange bearing the inner knob. By correspondingly displacing the ring, the claws can be disengaged from the counter-claws, whereby the inner knob is decoupled from the locking cam.

U.S. Pat. No. 6,460,903 B1 discloses a door lock with an inner knob and an outer knob acting on a door latch. The inner knob is permanently connected to the door latch via an output shaft, such that said door latch can be permanently retracted by a rotation of the inner knob at any time. The outside knob has a ring being non-rotatably connected to the corresponding handle with a spur toothing in which a coupling ring can be inserted by means of a slider. The coupling ring has two radially placed entraining wing parts, each having two teeth being complementary to the spur toothing. The entraining wing parts are mounted axially displaceable in two slots of a connecting element, such that a rotation of the coupling ring is transmitted to the connecting element. The connecting element has a receiving area in which the output shaft is mounted non-rotatably.

U.S. Pat. No. 6,460,903 B1 also describes an electronic door lock with two knobs that act on a door latch. The inner knob permanently acts on the latch, the outer knob can be indirectly coupled to an output shaft of the inner knob.

In WO 2011/119097 A1, a window handle with locking being adjustable by an electromotor is disclosed. Balls can be inserted by an axial slider in a radial direction in corresponding receiving areas of a rosette screwed to the window, thereby causing the window handle to be locked against rotation.

Alternatively, also clutches are known which are arranged under a cover being arranged directly on the door leaf and serving to connect a doorknob with a nut of a mortise lock (EP 1 662 076 B1, EP 1881135 A1, EP 1522659 B, DE 10 2009 018471 A). These find, however, only limited acceptance for aesthetic reasons.

SUMMARY

The object of the present invention is to simplify the—often perceived as cumbersome—release of the lock by means of a locking cylinder.

A door handle, also called doorknob, is a lever-like device for opening and closing the latch of a door. The door handle thereby acts via a shaft, usually a square shaft, on the so-called spindle hole (referred to, shortly, as a nut) of a mortise lock (see e.g. DIN 18 251). A door handle usually has two legs: a first leg the longitudinal axis of which generally, or even preferably, coincides with the rotation axis of the nut, and a second leg attached angled thereto and acting as a lever. For actuating the door handle, the second leg is pivoted about the longitudinal axis of the first leg, rotating the first leg accordingly. Usually, the first leg is much shorter than the second leg.

The door handle has a door-side output shaft and a handle facing away from the door. The output shaft may be, as usual, connected to the nut of a mortise lock via e.g. a square shaft. The handle serves to pivot the door handle about an axis of rotation. The handle serves to pivot the door handle about a rotation axis. The handle and the output shaft have a common rotation axis and are connected to one another via a preferably electro-mechanical clutch.

A shifting clutch (also referred to herein as a clutch) is to be understood as a coupling which can be opened and closed. In an open state of the clutch, the handle is freely rotatable with respect to the output shaft, i.e. the door cannot be opened. In a closed state of the shifting clutch, the handle and the output shaft are non-rotatably connected to each other, so the door can be opened. The adjustment of the shifting clutch between the two states "closed" and "open" is preferably carried out electromechanically, so that a lock control can switch the clutch between the two states.

Preferably, the output shaft has a recess on the side facing towards the handle, in which a coupling element is mounted preferably axially displaceable. The handle has a receiving area for receiving the coupling element, which receiving area is located preferably directly opposite to the recess. The recess, the coupling element and the receiving area are complementary to each other and are not rotationally symmetric to the rotational axis in at least one section, so that a rotation movement is transmitted from the handle to the output shaft via the coupling element, when the coupling element (more precisely, the at least one non-rotationally symmetrical section of it) engages in the complementary sections of both the recess and the receiving area. If the coupling element rotationally engages into the recess and the receiving area, the clutch is locked, and correspondingly the coupling element is in the closed-position. When the coupling element rotationally engages only in one of the receiving area and in the recess, the clutch is opened and the coupling element is in the open-position. Generally, the receiving area is also a recess of the handle. Merely for linguistic distinction between the two recesses, the term 'receiving area' is used. One could alternatively speak of a first recess (the recess) and a second recess (the receiving area).

A linear drive is arranged in the handle, which drive acts on the coupling element to displace the coupling element in axial direction out of the recess so far that, it engages both in the recess and in the receiving area in order to thereby close the coupling. For opening of the coupling, the coupling element is displaced from the receiving area back into the recess. Such a clutch is very reliable, compact and can transmit also high torques with only little material. In addition, this clutch can be arranged in a very narrow shaft, i.e. in a narrow door-side leg of a door handle. The door handle can therefore be correspondingly slim and does not necessarily differ visually from the usual rigid door handles that do not contain a clutch.

Preferably, the recess receives the coupling element completely if it is in its open position. In the closed-position of the coupling element, it is arranged preferably completely in a cavity formed by the recess and the receiving area. This allows to form the clutch particularly compact. In addition, the end faces of the output shaft and the handle preferably abut each other (thereby forming a rotation gap or a plain bearing), whereby tilting moments are introduced from the handle into the output shaft, which increases the stability of the door handle.

Preferably, the output shaft is rotatably mounted in a door-side recess of the handle. This can ensure that a displacement of the coupling element is not disturbed by forces acting on the handle in a direction radial with respect to the rotation axis. For absorbing such forces, the handle is preferably rotatably mounted relative to the door leaf. For this purpose, e.g. a rosette overlapping the door-side end of the handle can be formed as a bearing for the handle. Such rosette can also be fastened (e.g. by screws) to the door leaf from the inside of the door, and can thereby complicate an attack on the clutch of the door handle mounted on the outside. With regard to an adjustment of the clutch, the rosette preferably has no function, in this regard of the door handle is autonomous.

Preferably, the coupling element is pre-loaded or biased in the direction of the handle. For closing the door, it is then sufficient to release the way of the coupling element in the direction of receiving area. Once the output shaft and the handle are correspondingly aligned to each other, the coupling element is displaced such that it engages in the receiving area and in the recess. The clutch is now closed. For opening of the shifting clutch, the coupling element is moved out of the receiving area, whereby the pre-load (a bias) is increased again. For biasing, a biasing spring, e.g. a coil spring, may be arranged between the bottom of the recess and the coupling element. Preferably, a rosette for mounting on a door leaf overlaps the handle and is so connected with the handle via a return spring, such that the handle is biased against a stop toward its closed-position. Thereby, the handle is in a well-defined, e.g. usually horizontal position also with an open clutch.

Preferably, the handle has a door-side hollow shaft (a hollow shaft on a door-side of the handle), in which the output shaft and at least a part of the linear drive are disposed. Thereby, the handle protects the output shaft from unauthorized access and enables a particularly compact design. More preferably, the output shaft is rotatably mounted in the hollow shaft. When closing the switching clutch, the rotation is of course blocked or at least restricted.

For example, the handle may have a handpiece that is non-rotatably connected with the hollow shaft with two legs being arranged angled (that is, at an angle with respect) to each other. The door handle then has the form of a conventional door lever. For mounting, it is advantageous if the handpiece comprises at least two half-shells, between which at least one fixing portion of the hollow shaft is arranged. For example, the half-shells may have a door-side external thread, on which a union nut is seated, which fixes the half-shells on the hollow shaft. The union nut should preferably be protected against unauthorized opening, e.g. be overlapped by a rosette or be locked by a stop only being reachable after dismounting the door handle.

In the leg facing away from the door (i.e. in the leg of the handle being at least approximately parallel to the door leaf), a battery for energy supply of the door handle may be provided. For example, the ends of the half-shells facing away from the door may open into a hollow profile, which holds together their ends and e.g. provides space for at least one battery or for at least parts of a circuitry, such as a lock control.

The linear drive preferably has at least one control member that is axially displaceable and rotatably mounted in the handle, which engages in the coupling element in such a way that a displacement of the control member results in a displacement of the coupling element. Accordingly, the control member has at least one "open-position" in which the clutch is open and one "closed-position" in which the clutch is closed.

The control member preferably has at least one (e.g. slotted) thread, into which a pin or a complementary threaded portion engages, which is rigidly connected to the handle. Alternatively, the control member can also have only one thread-like contact surface for the pin or the threaded section, in which case the control member and/or the pin or threaded section, respectively, are mutually spring-loaded. Thereby, a rotational movement of the control member can be converted into a linear movement, i.e. a rotation of the control member also causes a linear movement, preferably axially to the rotation axis.

The drive of the control member may e.g. be carried out by a motor controlled by a lock control. The motor may preferably be arranged in the handle and may drive a drive wheel for the control member, at least indirectly. The drive wheel may preferably be arranged coaxially to the rotation axis of the control member. The drive wheel is connected to the control member in order to entrain it with a rotational movement. Preferably, the control member and the drive wheel are connected via a spring element, e.g. a coil spring. The spring element compensates on the one hand the changes in distance between the adjusting element and the drive wheel during axial displacement of the adjusting element, and in addition serves as energy storage, when the adjusting element is blocked. If for example the control member is to be moved in the direction of the output shaft, it may occur that the coupling element, e.g. by actuating the handle, is stressed such that it jams. Accordingly, a movement of the control member in the direction of the coupling element is not possible. The motor can be controlled by the lock control, regardless of this circumstance. Thereby, it drives the drive wheel and loads the spring element in the corresponding direction of rotation. Once the coupling element is relieved, i.e. no longer jammed, the blockage of the control member is also relieved. The energy stored in the spring element is converted into a displacement of the control member, and thereby also the coupling element is displaced correspondingly.

Preferably, the drive wheel is partially toothed, i.e. it has a toothed region and in the extension of the toothed region as well a non-toothed region, wherein the angular range being spanned by the toothed region corresponds to the rotation angle of the drive wheel, which rotation angle is necessary to adjust the control member between its "open-position" (in which the clutch is open) and its "closed-position" (in which the clutch is closed).

In the handle, particularly in a cavity between at least two half-shells of the handle, electrical components, e.g. a lock control or a part thereof may be arranged. The lock control is adapted to exchange data with an electronic key, (e.g. an RFID transponder) via a data link (e.g. a radio data link). Based on the data, the lock control checks the locking authorization of the key and drives the linear drive, if the locking authorization does not correspond with the state of the clutch, i.e. for a given locking authorization the clutch is closed and is otherwise opened, if necessary.

Herein the term 'non-rotatably connected' is used to express that two pieces are connected such that a transmission of torque from one piece to the other is (and vice versa) is possible. For example, when clutch having an input shaft and an output shaft is closed, the input shaft and the output shaft of the clutch are 'non-rotatably connected'. In case the clutch is open, they are 'rotatably connected'.

BRIEF DESCRIPTION OF THE DRAWINGS

In the following, the invention will be described by way of example, without limitation of the general inventive concept, on examples of embodiment and with reference to the drawings.

Figure 1A:
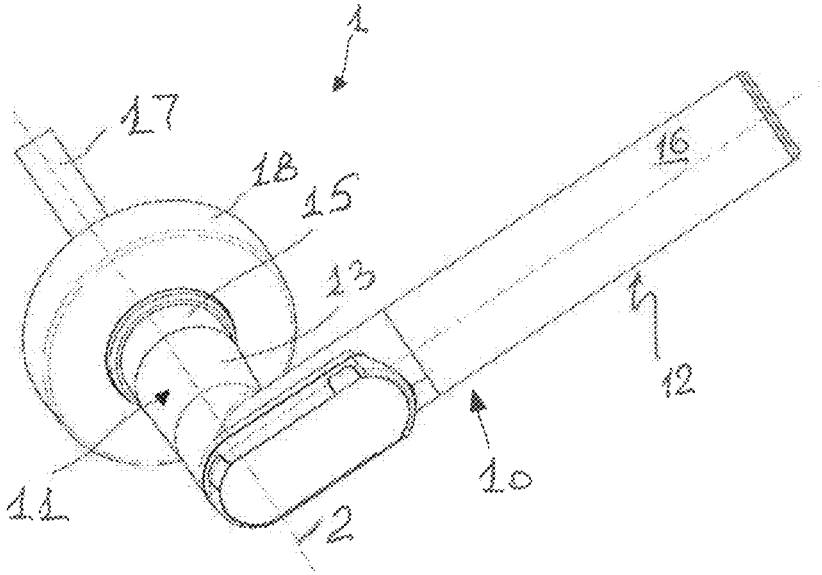
FIG. 1*a* shows a perspective view of a door handle.

While the invention can be modified without changing its scope and take alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Figure 1B:
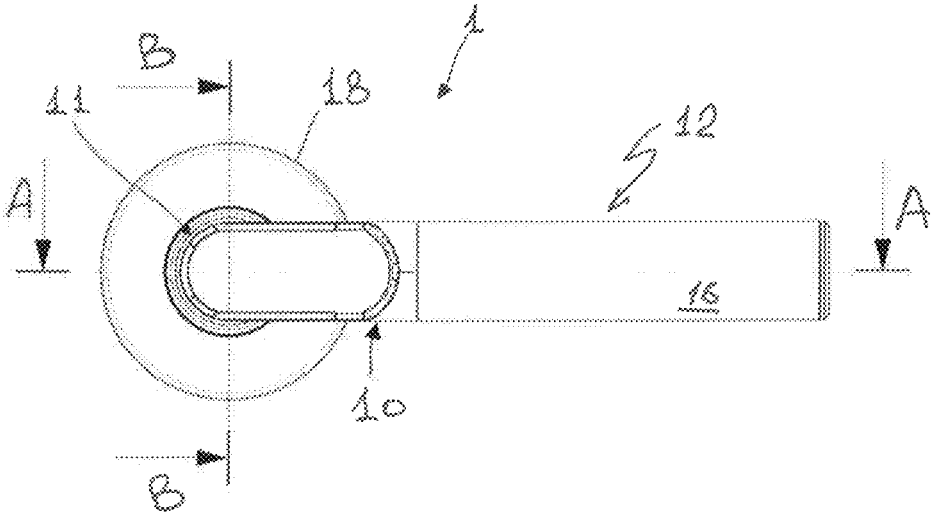
FIG. 1*b* shows the door handle of FIG. 1*a* in the front view.
Figure 2A:
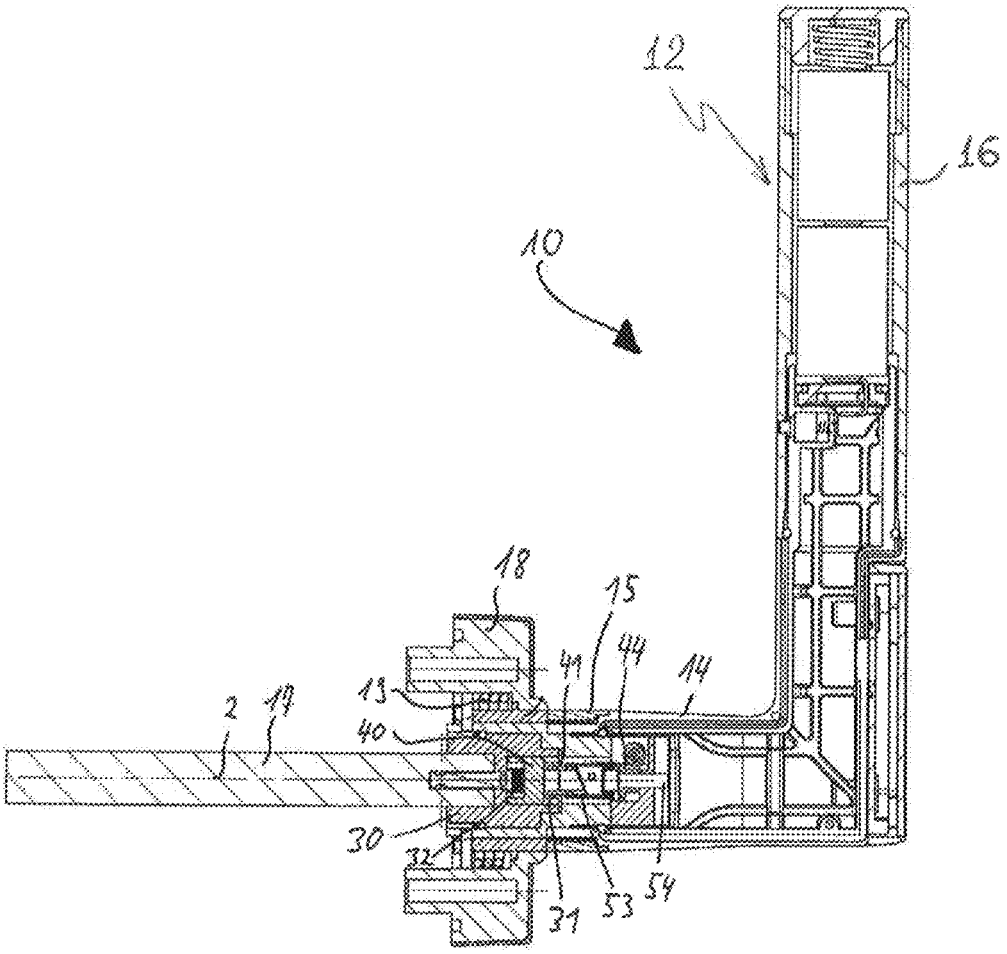
FIG. 2*a* shows a longitudinal section of the door handle along the plane A-A.
Figure 2B:
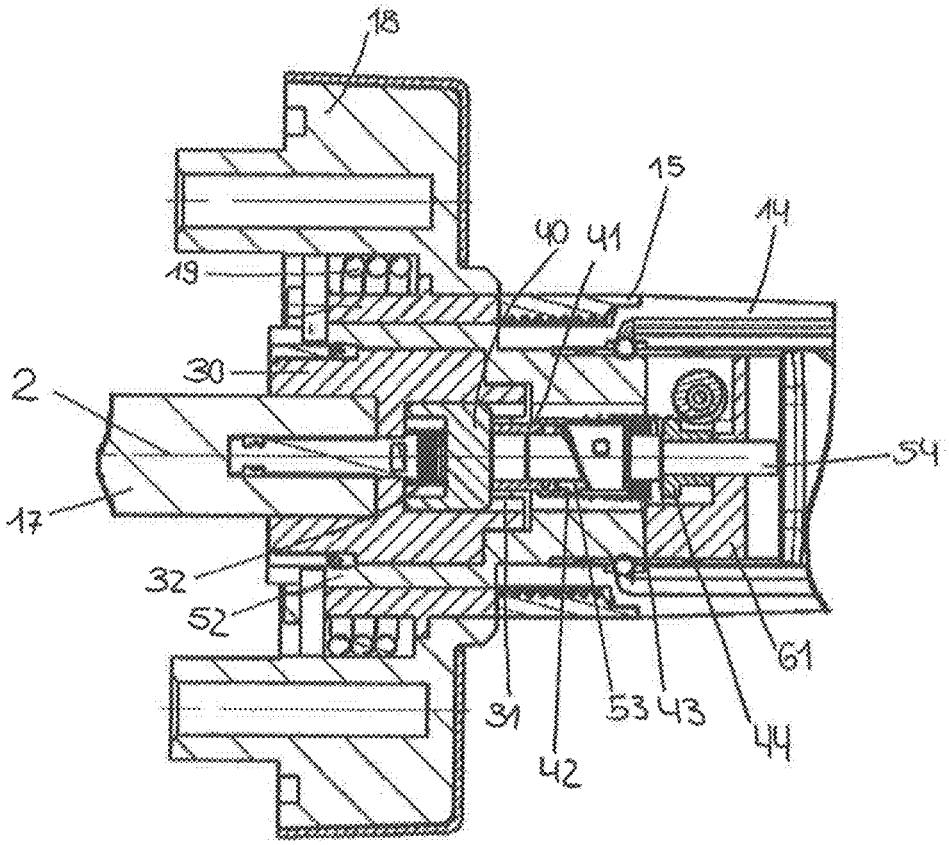
FIG. 2*b* shows a detail of FIG. 2*a*.
Figure 3A:
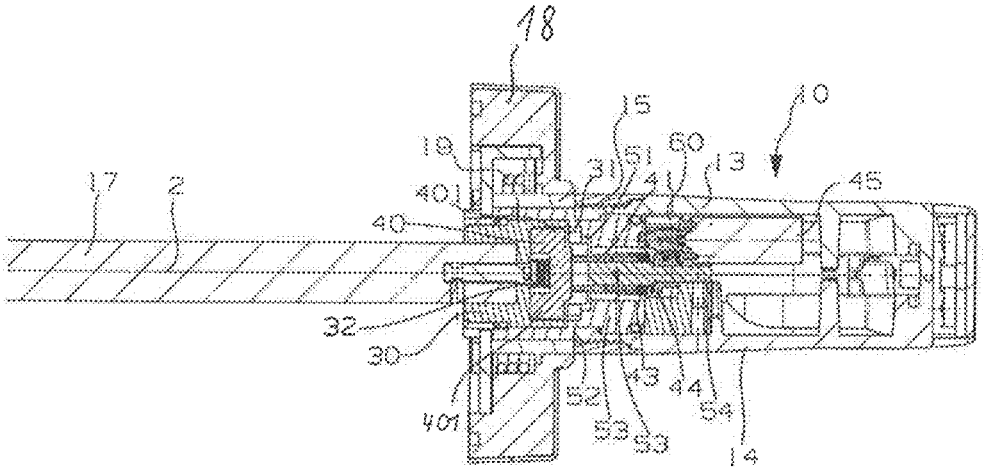
FIG. 3*a* shows a longitudinal section of the door handle along the plane B-B.
Figure 3B:
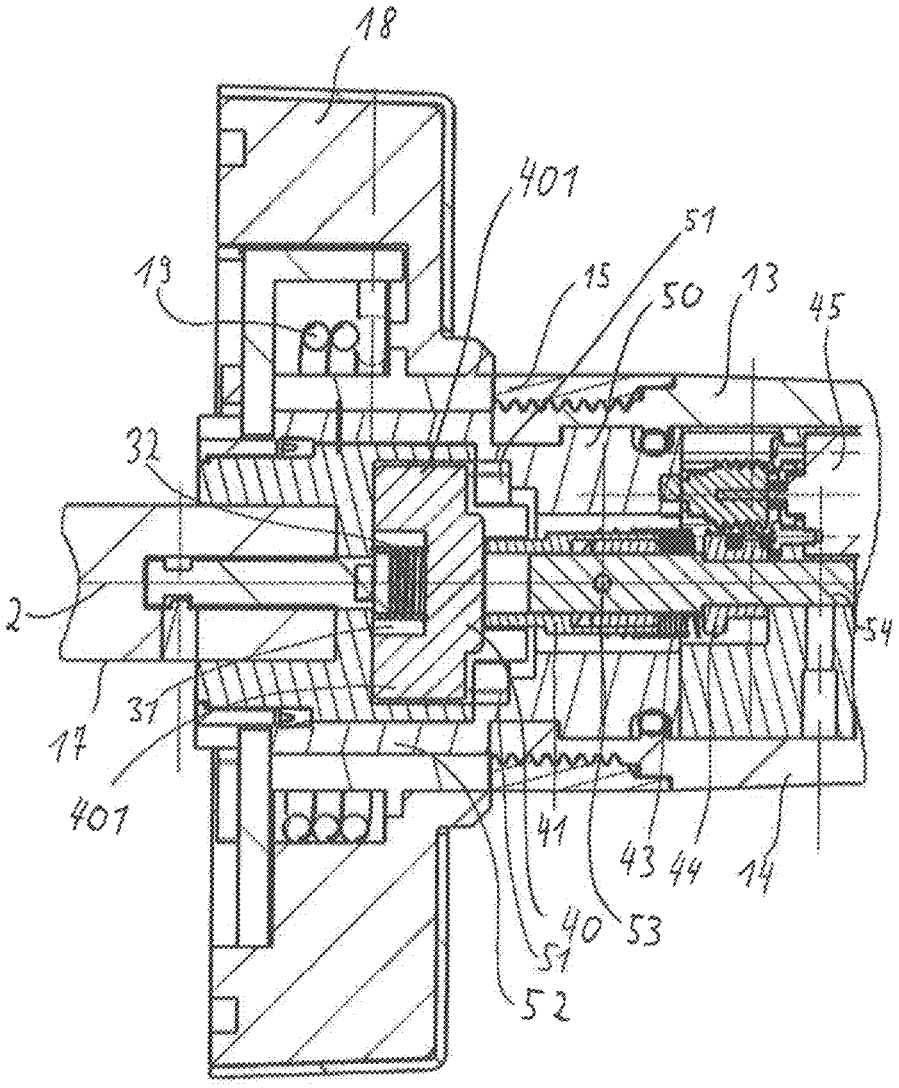
FIG. 3*b* shows a detail of FIG. 3*a*.

FIG. 1 shows a door handle 1, here in the form of a door lever. The door handle 1 has a handle 10 being pivotable about a rotation axis 2, with a door-side first leg 11, the longitudinal axis 2 of which is oriented in approximately orthogonal direction with respect to a door leaf (when mounted on the door), and with a second leg 12 angled with respect to the first leg. The region in which the first and second legs meet at an angle consists of two half-shells 13, 14 being held together by a nut 15, located on the door side with respect to the half-shells 13, 14 and a sleeve 16 of the second leg 12, located on the other side. As indicated, the handle 1 may have a receiving area for a square shaft 17, to non-rotatably couple the door handle with the nut of a mortise lock. A rosette 18 may be provided to fasten and mounting the door handle 1 to a door leaf and protect the clutch (which will be described in more detail below) against manipulation. An output shaft 30 (cf. FIGS. 2*a* to 3*b*) is covered by the handle 10, which output shaft 30 acts on the (illustrated as) square shaft 17, i.e. it is connected with the square shaft 17 in a manner permitting transmission of a rotational movement. To be more precise, the rotational movements about the longitudinal axis 2 are transmitted. In contrast thereto, tilting moments applied orthogonally to the longitudinal axis 2 are preferably at least substantially absorbed from the bearing of the handle 10 by the rosette 18, and are introduced into the door leaf. A clutch is located between the handle 10 and the output shaft 30, in order to non-rotatably connect the handle 10 with the output shaft 30 by means of a lock control (clutch closed) or in order to uncouple both (clutch open). Preferably, the handle 10 rests on the rosette 18 via a return spring 19, thus, the door handle does not hang down when the clutch is open. The rosette 18 may preferably be fastened to the door leaf from the inner side of the door, or may be fixed otherwise with same.

The functioning of the door handle is explained by way of the two sections A-A and B-B, i.e. of FIGS. 2*a* to 3*b*: The door handle 1 has an output shaft 30 on the door side, which is rotatably mounted in a hollow shaft 50 of the handle 10. The output shaft 30 and the hollow shaft 50 have a common rotational axis 2 and may be non-rotatably coupled to each other via the clutch (or decoupled, if the clutch is open). The output shaft 30 is non-rotatably connected with the square shaft 17, as illustrated. The hollow shaft 50 is non-rotatably connected with the handle 10. In the example shown, the hollow shaft 50 has an attachment portion 52 by which it is fixed between the two half-shells 13, 14.

The output shaft 30 has a recess 31 on its side facing towards the hollow shaft 50. In the recess 31 sits a coupling element 40. The coupling element 40 is axially displaceable but not freely rotatable. The coupling element 40 is for example (circularly-)cylindrical and has a cam 401 on at least one side (two cams 401 are shown) which engages (engage) in a (each) complementary groove of the recess 31. Alternatively, the coupling element 40 may have at least one flattened portion which interacts with a complementary flattened portion of the hollow shaft 50 and the output shaft 30. It is only important that the coupling element 40 may (depend-ent on its position) generate a torque-transmitting form-fit connection with the hollow shaft 50 and/or with the output shaft 30. The cylindrical part of the coupling element 40 is arranged coaxially with the rotation axis.

The hollow shaft 50 has a receiving area 51 opposite to the recess 31. The receiving area 51 is also complementary to the form of the coupling element 40. If the coupling element 40 is displaced into the receiving area 51 in axial direction to an extent that the coupling element 30 engages both in the recess 31 and in the receiving area 51, the hollow shaft 50 and thus the handle 10 are non-rotatably connected with the output shaft 30, i.e. the clutch is closed. Therefore, the output shaft 30 is taken upon actuation of the handle, and the rotation movement is transmitted to the square shaft 17. In other words, the rotation of the handle is transmitted via the clutch to the output shaft.

When the coupling element 40 as shown is pushed back into the recess 31 of the output shaft 30 so far that it no longer engages with the receiving area 51 of the hollow shaft, the clutch is open. In the open state of the clutch, upon actuation of the door handle, the rotation is not transmitted to the output shaft 30.

The adjustment of the coupling element 40 is preferably carried out by means of a control member 41. The control member 41 as shown is rotatably mounted and is configured to be axially displaceable in the hollow shaft 50 on a rod 54. The control member 41 has a thread-shaped slot 42 (more generally: a thread 42) into which a pin 53 engages radially as a complementary threaded section, said threaded section 53 is connected at least substantially rigid to the handle 10 via rod 54. In the example shown, the rod 54 is held by a gear block 61; other fastenings are also possible. It is only important that the rod 54 and the control member 41 can be rotated relative to each other about the longitudinal axis 2. Upon rotation of the control member 41 about its longitudinal axis 2, said control member is either pushed forward in the direction towards the output shaft 30 according to the rotational direction, by interaction of the threaded section 53 and the thread 42, or is pushed back in the opposite direction. If the control member 41 is pushed forward, it pushes the coupling element 40 against the force of a spring 32 (which spring rests against the bottom of the recess 31) so far into the recess 30, that the coupling element 40 is not engaged with the receiving area 51; the clutch is now open. The control member has reached one of its two end positions, namely its "open end position". If the control member 41 is rotated back and thereby retracted, the coupling element 40 follows the control member 41 into the receiving area 51 of the hollow shaft 50 due to the spring 32, wherein the spring 32 is at least somewhat relaxed; the clutch is closed. The control member 41 now has reached the other end position, the so-called "closed end position".

To displace the control member 41 axially, it is rotatably driven about its longitudinal axis 2. For this purpose, a motor 45 driven by a lock control (not shown) drives a drive wheel 44 via a preferably self-locking gear, the drive wheel 44 being arranged preferably coaxially with regard to the control member 41. The drive wheel 44 thereby entrains a first end of a spring element 43 (at least indirectly). The other, second end of the spring element 43 is (at least indirectly) attached to the control member 41 such that upon rotation of the drive wheel 44 the control member 41 is rotated, provided that the coupling element is not blocked. Therewith, the adjusting element 41 and thus also the coupling element 40 are axially displaced due to the threaded section 53 engaging axially into the thread. If, however, the control member is axially blocked, the spring element 43 is loaded by the rotation of the both ends against each other. Once the blockage is relieved, the control member 41 follows the rotation of the drive wheel 44, wherein the spring element is relaxed again.

If the drive wheel 44 is driven to open the clutch, i.e. to push forward the control member 41, it may occur that at the same time the handle 10 is actuated. In this case, the coupling element 40 is clamped between the output shaft 30 and the hollow shaft 50 and thereby blocks an axial displacement of the control member 41. The coupling element is jammed. Therefore, only the spring element 43 is tensioned by the rotation of the drive wheel 44, i.e. kinetic energy is stored as potential energy in the spring element 43. If the handle 10 is released, the clamping of the coupling element 40 is relieved, i.e. the control member 41 being pre-loaded by the spring element 43 can push the coupling element 40 out of the receiving area 51 and thus into the "open-position".

Likewise, it may occur that the clutch is open when the door handle is actuated. In this case, the receiving area 51 of the hollow shaft 50, i.e. of the handle is rotated against the recess 31 of the output shaft 30, and the coupling element 40 cannot engage with the receiving area 51 even if the control member 41 is retracted. The coupling element 40 is not able to follow the control member 41, despite the biasing of the bias spring 32. Once the door handle is released, the grooves of the recess 31 and the receiving area 51 align, such that the coupling element 40 engages in the receiving area 51 of the hollow shaft 50, thereby closing the clutch.

Preferably, the drive wheel 44 is a partly toothed gear, i.e. the drive wheel has at least a first toothed region and a second non-toothed region, wherein the non-toothed region is disposed in the imaginary extension of the toothed region. For adjusting the first end of the spring element 43 being at least indirectly entrained by the drive wheel, an output element (e.g. a screw (see FIG. 2*a*), a gear rack, or other gear) being driven by motor 45 engages in the toothed region of the drive wheel 44. The toothed region is arranged on the drive wheel in a manner that the toothing no longer engages in the output element, as soon as the first end of the spring element 43 has reached one of its two end positions. In the first end position, the control member is spring-loaded in the direction of its "closed end position" and in the other end position it is spring-loaded towards its "open end position". To adjust the control member 41 between its respective end positions, it is sufficient to drive the motor for a sufficiently long time period with the corresponding rotation direction. Once the entrained end of the spring element 43 has reached its desired end position, the output element and the drive wheel 44 disengage. Thus, the motor 45 can be operated time-controlled, and sensors for detecting an end position of the first end of the spring element are not necessary. It is sufficient to determine the time constant for controlling the motor to be big enough. If the desired end position of the entrained first end of the spring element 43 has been reached and the drive wheel 44 and the driven element are not engaged with each other, the control member is now spring-loaded in the direction of its respective end position and the "last tooth" of the toothed region is correspondingly pushed against the complementary toothing of the output element by the spring element 43. If the control member 41 is to be shifted into the other end position, it suffices to drive the motor 45 again for a sufficiently long time period, but with the reverse direction. Again, the teeth engage in one another until the entrained end of the spring element 43 has reached its second end position. Now, the control member is spring-loaded in the direction of its corresponding (different) end position, and due to the spring-load, the "first tooth" of the toothed region fits closely to the complementary toothing of the output element. Therefore, the drive wheel 44 would again be entrained by the output element with a repeated reversal of rotation direction of the motor 45.

The door handle has been described by way of an example, in which an open clutch the coupling element is seated in the output shaft and the linear drive is integrated in the handle. This the output shaft to be kept relatively short, which makes an attack difficult. In principle, the clutch can be rotated by 180° . Then the coupling element 40 would sit in the handle in case of the open position. Independently of this, the linear drive may be arranged in the handle, or in or at the output shaft. An essential advantage of the invention is that the rosette does not accommodate any elements being necessary for switching of the clutch. Further it should be noted, that door handle can as well have the form of a door knob. In this case the second leg is omitted and the first leg is thickened to thereby provide a handle.

It will be appreciated to those skilled in the art having the benefit of this disclosure that this invention is believed to provide a door handle. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

2 rotation axis/longitudinal axis
10 handle
11 first leg
12 second leg
13 upper half-shell
14 lower half-shell
15 union nut
16 sleeve
17 square shaft
18 rosette
19 return spring
30 output shaft
31 recess of the output shaft
32 bias spring
40 coupling element
401 cam
41 control member
42 slot/thread
43 spring element, e.g. coil spring
44 drive wheel
45 motor
50 hollow shaft
51 receiving area
52 attachment portion
53 pin/threaded section
54 rod
61 block gear

The invention claimed is:

1. A door handle device configured to actuate the locking mechanism of a door, the door handle device comprising a handle and an output shaft, the output shaft and the handle having a common rotation axis and connected with one another via an electromechanical clutch, wherein the electromechanical clutch is disposed in one of the first and second orientations along the rotation axis, the second orientation being a reverse of the first orientation, the output shaft has, on a side thereof facing towards the handle, which is connected to the output shaft via the electromechanical clutch, a recess configured to receive a coupling element, and the handle, which is connected to the output shaft via the electromechanical clutch, has a receiving area configured to receive the coupling element, said receiving area arranged opposite to the recess, and a linear drive, at least a portion of which is disposed in a hollow of the handle, said linear drive configured to act on the coupling element to displace the coupling element in axial direction to close the clutch, such that said coupling element engages in both the recess and the receiving area, and to displace the coupling element (a) out of the receiving area into the recess to open the clutch, when the clutch is disposed in the first orientation, or (b) out of the recess into the receiving area to open the clutch, when the clutch is disposed in the second orientation.

2. The door handle device according to claim 1, wherein the output shaft is rotatably mounted in a recess of said handle at an end thereof that faces the door.

3. The door handle device according to claim 1, wherein the coupling element is biased in at least one of a direction of the handle and a direction of the output shaft at least in a case when the clutch is open.

4. The door handle device according to claim 1, further comprising a rosette configured for attachment at a door leaf, wherein said rosette overlaps the handle and is connected with the handle via a return spring to bias the handle towards a position in which the handle is closed.

5. The door handle device according to claim 1, wherein the handle has a hollow shaft at an end thereof facing the door, said hollow shaft accommodating at least a section of the output shaft and at least a part of the linear drive.

6. The door handle device according to claim 5, wherein the handle has a union nut and a handpiece, non-rotatably connected with the hollow shaft, said handpiece having two legs arranged at an angle with respect to each other, said handpiece further having at least two half-shells which, when held together by the union nut, fixate an attachment portion of the hollow shaft therebetween.

7. The door handle device according claim 6, further comprising a sleeve disposed to hold together ends, of the at least two half-shells, that face away from the door when the handle is attached to the door, wherein said ends open in said sleeve.

8. The door handle device according to claim 6, wherein at least one battery for energy supply of the door handle is positioned in at least one of the two legs.

9. The door handle device according claim 8, further comprising a sleeve disposed to hold together ends, of the at least two half-shells, that face away from the door when the handle is attached to the door, wherein said ends open in said sleeve.

10. The door handle device according to claim 1, wherein the linear drive has at least one control member, said at least one control member is supported by and configured in the handle to displace axially and to rotate, wherein the at least one control member abuts the coupling element and is configured to displace said coupling element axially, wherein the at least one control member has a thread, in which at least one of a radial pin and a threaded section engages, said at least one of the radial pin and the threaded section is rigidly connected with the handle, wherein upon rotation of the at least one control member about its longitudinal axis, said at least one control member is displaced axially relative to the handle, and a spring element connecting a coaxial drive wheel with the at least one control member such that upon rotation of the drive wheel either the at least one control member is entrained or, in case of the at least one control member being blocked from moving axially, the spring element is loaded.

11. The door handle device according to claim 10, further comprising a lock control in the handle to exchange data with at least one electronic key, during an operable cooperation of the handle with the at least one electronic key, to identify a locking authorization of the at least one electronic key based on the data, and to close the clutch in case of a given locking authorization, and otherwise to keep the clutch open or to open the clutch.

12. The door handle device according to claim 1, further comprising a lock control in the handle to exchange data with at least one electronic key, during an operable cooperation of the handle with the at least one electronic key, to identify a locking authorization of the at least one electronic key based on the data, and to close the clutch in case of a given locking authorization, and otherwise to keep the clutch open or to open the clutch.

13. A door handle device configured to actuate the locking mechanism of a door with a handle and an output shaft, the output shaft and the handle having a common rotation axis and connected with one another via an electromechanical clutch, wherein the electromechanical clutch is disposed in one of the first and second orientations along the rotation axis, the second orientation being a reverse of the first orientation, wherein the output shaft has, on a side thereof facing towards the handle that is connected to the output shaft via the electromechanical clutch, a recess configured to receive a coupling element, wherein the handle, which is connected to the output shaft via the electromechanical clutch, has a receiving area configured to receive the coupling element, said receiving area arranged opposite to the recess;

a linear drive, at least a portion of which is disposed in a hollow of the handle, said linear drive configured to act on the coupling element to displace the coupling element in axial direction to close the clutch, such that said coupling element engages in both the recess and the receiving area, and to displace the coupling element (a) out of the receiving area into the recess to open the clutch, when the clutch is disposed in the first orientation, or (b) out of the recess into the receiving area to open the clutch, when the clutch is disposed in the second orientation, and wherein the linear drive has at least one control member, said at least one control member is supported by and configured in the handle to displace axially and rotate, wherein the at least one control member abuts the coupling element and is configured to displace said coupling element axially, wherein the at least one control member has a thread, in which at least one of a radial pin and a threaded section engages, said at least one of the radial pin and the threaded section being rigidly connected with the handle, wherein upon rotation of the at least one control member about a longitudinal axis thereof, said at least one control member is displaced axially relative to the handle;

and a spring element connecting a coaxial drive wheel with the at least one control member such that upon rotation of the drive wheel either the at least one control member is entrained or, in a case of the at least one control member being blocked from moving axially, the spring element is loaded.

14. The door handle device according to claim 13, further comprising a lock control in the handle to exchange data with at least one electronic key, during an operable cooperation of the handle with the at least one electronic key, to identify a locking authorization of the at least one electronic key based on the data, and to close the clutch in case of a given locking authorization, and otherwise to keep the clutch open or to open the clutch.

* * * * *